US007260235B1

(12) United States Patent
Henricksen et al.

(10) Patent No.: US 7,260,235 B1
(45) Date of Patent: Aug. 21, 2007

(54) LINE ELECTROACOUSTICAL TRANSDUCING

(75) Inventors: Clifford A. Henricksen, Framingham, MA (US); Kenneth D. Jacob, Framingham, MA (US)

(73) Assignee: Bose Corporation, Framingham, MA (US)

( * ) Notice: Subject to any disclaimer, the term of this patent is extended or adjusted under 35 U.S.C. 154(b) by 843 days.

(21) Appl. No.: 09/688,525

(22) Filed: Oct. 16, 2000

(51) Int. Cl.
*H04R 1/02* (2006.01)
*H04R 9/06* (2006.01)

(52) U.S. Cl. ..... 381/335; 381/182; 181/199

(58) Field of Classification Search ..... 381/335, 381/385, 386, 300, 345, 182, 186, 387, 395; 181/199, 144, 189
See application file for complete search history.

(56) References Cited

U.S. PATENT DOCUMENTS

| | | | | |
|---|---|---|---|---|
| 3,125,181 | A | 3/1964 | Pawloski | |
| 3,299,206 | A * | 1/1967 | Klepper | 381/387 |
| 4,031,318 | A * | 6/1977 | Pitre | 381/386 |
| 4,042,778 | A * | 8/1977 | Clinton | 381/182 |
| 4,267,405 | A * | 5/1981 | Russell | 381/305 |
| 4,797,633 | A * | 1/1989 | Humphrey | 330/297 |
| 4,940,108 | A * | 7/1990 | Selby | 181/145 |
| 5,588,063 | A * | 12/1996 | Edgar | 381/300 |
| 5,802,190 | A * | 9/1998 | Ferren | 381/182 |
| 6,101,261 | A * | 8/2000 | Brown et al. | 381/386 |
| 6,215,881 | B1 * | 4/2001 | Azima et al. | 381/152 |
| 6,556,684 | B1 * | 4/2003 | Macey | 381/89 |
| 6,628,793 | B1 * | 9/2003 | Porzilli et al. | 381/182 |
| 6,643,379 | B1 * | 11/2003 | Onglao | 381/351 |
| 6,834,113 | B1 * | 12/2004 | Liljehag et al. | 381/99 |

FOREIGN PATENT DOCUMENTS

| | | |
|---|---|---|
| EP | 0 791 279 | 5/1996 |
| JP | H5-276591 | 10/1993 |
| JP | 06307107 | 1/1994 |
| JP | 06225379 | 12/1994 |
| JP | H8-251686 | 9/1996 |
| WO | WO96/14723 | 5/1996 |

OTHER PUBLICATIONS

Drawing labeled Bose, Cabinet, Wood, dated May 21, 1998.
Drawing labeled I-DEAS Master Series 5m3, perspective view, May 21, 1998.
Hardcopy printout of website http://www.eaw.com, 2000.
Hardcopy printout of website http://www.abtec.demon.co.uk, Dec. 1999.
"Manufacturer's Showcase", Stereophile, Oct. 2000, p. 254 (advertisement).
Hardcopy printout of website http://www.nearfieldacoustics.com, Sep. 2000.

(Continued)

*Primary Examiner*—Xu Mei
(74) *Attorney, Agent, or Firm*—Fish & Richardson P.C.

(57) ABSTRACT

A line array loudspeaker system including a large number of small, regularly and closely spaced acoustical drivers. Each of the acoustical drivers receives essentially the same audio signal. In another embodiment, a line array includes a plurality of portable line array modules that are constructed and arranged to be attached end to end to form a longer line array.

8 Claims, 7 Drawing Sheets

OTHER PUBLICATIONS

Hardcopy printout of website http://www.duran-audio.com, Aug. 2000.
Hardcopy printout of website http://www.audiotechnology.se, Dec. 1999.
Hardcopy printout of website http://www.omnya.com, Dec. 1999.
Briggs, G.A. (Ed. Cooke, Jr., R.E.) *Loudspeakers,* pp. 313-314, (c)May, 1948.
Augspurger, G.L., "The Colinear Array—a Two-Way Loudspeaker System" (c)1970.
Smith, David L., "Discrete-Element Line Arrays—Their Modeling and Optimization", J. Audio Eng. Soc., vol. 45, No. 11, Nov. 1997, pp. 949-964.
Audio Reviews, "The Nearfield Acoustics PipeDreams: Ears Wide Open", The Sound, Issue 121, pp. 101-109, 2000.
Jordan, E.J., "Loudspeaker Enclosure Design", Wireless World, Jan. 1956, pp. 8-14; 75-79.
Jordan, E.J., "Multiple-Array Loudspeaker System", Wireless World, Mar. 1971, pp. 132-134.
Meyer, David G., "Multiple-Beam, Electronically Steered Line-Source Arrays for Sound-Reinforcement Applications," J. Audio Eng. Soc., Vol. 38, No. 4, Apr. 1990, pp. 237-491.
Augspurger, G.L., et al. "An Improved Colinear Array", Oct. 1983.
Pawlowski, R. J., "The Line Radiator," Audio, Jul. 1961, pp. 19-21.

* cited by examiner

Notes:

1) The sources are equalized to have the same frequency response and level at 6'8" (2m).
2) The effect of a floor reflection is included for both sources.
3) SPL is measured at floor height. (Results at ear height will be similar, but are more difficult to compute.)

LINE ELECTROACOUSTICAL TRANSDUCING

STATEMENT REGARDING FEDERALLY SPONSORED RESEARCH OR DEVELOPMENT

Not applicable.

CROSS-REFERENCE TO RELATED APPLICATIONS

Not applicable.

The invention relates to line array loudspeaker loudspeakers and to portable loudspeakers for performers and orators or other events using sound amplification.

BACKGROUND OF THE INVENTION

Line array loudspeaker loudspeakers are loudspeakers in which the radiating surface is long and narrow and typically a straight line, radiating in a direction perpendicular to the line. Line speakers are discussed generally at pages 35 through 36 of *Acoustical Engineering*, 1991 Edition, by Harry F. Olsen.

One characteristic of line array loudspeakers is that in the near field, the sound energy intensity decreases less rapidly than with point sources. The sound energy intensity of point sources drops off approximately as $$\frac{1}{r^2},$$

where r is the distance from the point source to the listening point. In the near field, the sound energy intensity from line array loudspeakers drops off less rapidly, theoretically as $$\frac{1}{r}.$$

Practical implementations of line array loudspeakers are frequently individual acoustical drivers arranged in a line.

It is an important object of the invention to provide an improved line array loudspeakers. It is another important object of the invention to provide an improved loudspeaker system for performers.

BRIEF SUMMARY OF THE INVENTION

In one aspect of the invention a loudspeaker system includes a first loudspeaker array. The first array includes an enclosure having a width and a height and at least six acoustic drivers having radiating surfaces, each of the acoustic drivers having a diameter less than three inches. The at least six drivers are positioned in the enclosure in a first substantially straight line, substantially regularly spaced so that the edges of the radiating surfaces are less than two inches apart, wherein the first array is constructed and arranged to radiate sound in a predetermined frequency range.

In another aspect of the invention, a loudspeaker system, includes a first portable array module, including a portable enclosure, and at least six acoustic drivers, positioned in the enclosure in a substantially straight line. The loudspeaker system also includes a second portable array, including a second portable enclosure and a plurality of acoustic drivers, positioned in a substantially straight line; and an attachment system for attaching the first array to the second portable array in a manner so as to extend the substantially straight line.

In another aspect of the invention, a loudspeaker array module includes a portable enclosure having an attachment system for attaching the module to a second module. The loudspeaker array module includes at least six acoustic drivers. Each of the drivers has a radiating surface, each of the drivers having a diameter less than three inches, the at least six drivers positioned in the enclosure in a substantially straight line, regularly spaced so that the edges of the radiating surfaces are less than one inch apart. The loudspeaker array module is constructed and arranged to radiate sound over essentially the full range of the audible frequency spectrum.

In another aspect of the invention, a method for improving the power transduced per unit radiating area of a line array loudspeaker array includes mounting in a substantially straight line a plurality of acoustic drivers, each of the drivers having a diameter of less than three inches and each of the drivers having a radiating surface having an edge; and placing the acoustic drivers in the line so that the edges of radiating surfaces of adjacent acoustic drivers are separated by no greater than one inch.

A loudspeaker system for a live source of sound, includes a line array loudspeaker comprising a line array plurality of acoustic drivers. Each of the drivers has a diameter less than three inches. The plurality of drivers are positioned in an enclosure in a substantially straight line, regularly spaced less than one inch apart, the line array being constructed and arranged to be placed in the near vicinity of the live source of sound, facing an audience.

In yet another aspect of the invention, a loudspeaker system for a public facility having a listening area having a floor and an intended listening height range above the floor, includes a line loudspeaker array having a top and a bottom, comprising a plurality of acoustical drivers array in a substantially straight line connecting the top and the bottom, the top and the bottom defining planes perpendicular to the line. The array is dimensioned and positioned such that the intended listening height lies between the plane defined by the top and the plane defined by the bottom and such that the bottom is substantially in the vicinity of the floor.

Other features, objects, and advantages will become apparent from the following detailed description, when read in connection with the accompanying drawing in which:

DETAILED DESCRIPTION

Figure 1:
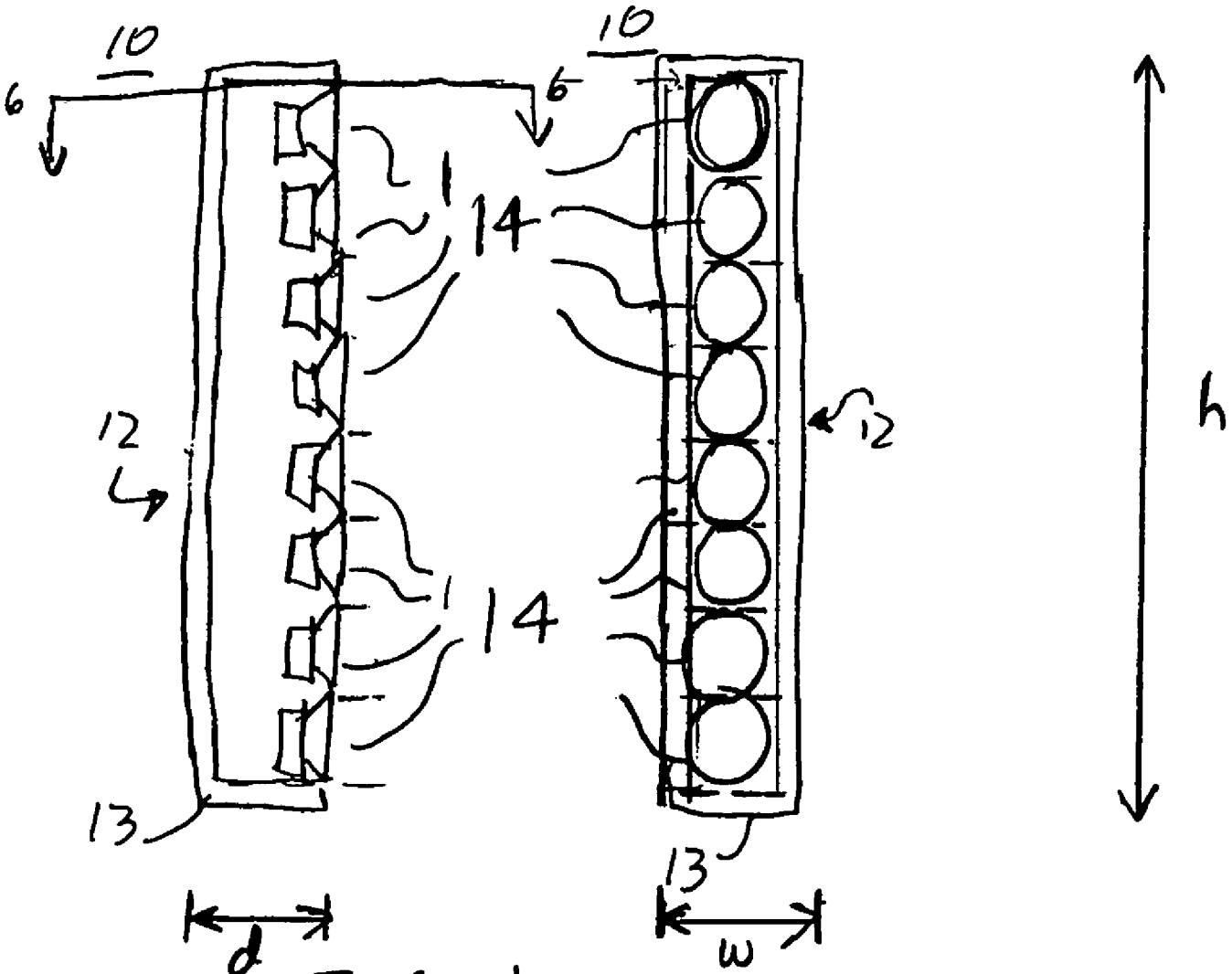
FIG. 1 is a cross-sectional and front plan view of a line array according to the invention.

With reference now to the drawing and more particularly to FIG. 1, there is shown a loudspeaker system in accordance with the invention. Line array loudspeaker system 10 includes a line array loudspeaker module 12. Line array loudspeaker module 12 has a large number (6 or more) of small (<3 inch diameter or approximately the wavelength of a 5 kHz sound wave) acoustical drivers 14, preferably an acoustical driver such as a cone driver in which the radiating surface is wide relative to the total width of the driver. Drivers are typically round, but may be oval or "racetrack" drivers, with a smaller diameter of less than three inches. Acoustical drivers 12 are arranged in a line, which may be a straight line, when viewed from both the front and side. The acoustical drivers are closely spaced (that is, they are mounted so that the edges of the radiating surfaces are close to each other, and such that the nonradiating portion of the line array loudspeaker module is small. The line array loudspeaker module 12 is enclosed by enclosure 13. The front of line array loudspeaker module 12 may be covered with an acoustically transparent covering of cloth or mesh (not shown in this view) to protect acoustical drivers 14.

In one embodiment, line array loudspeaker module 12 contains twelve 2.5 inch diameter cone type acoustical drivers, commercially available from Bose Corporation of Framingham, Mass., mounted approximately 3 inches center to center, so that there is a gap of approximately 0.75 inches between the edges of the radiating cones. Enclosure 13 is a closed back structure approximately thirty six inches in height h, three inches in width w, and four inches in depth d. The aspect ratio (the height relative to the width) of the module is 12:1. In typical line array systems having a plurality of line array modules, the aspect ratio may be 24:1 or 36:1. The line array module 12 weighs about 19 pounds, so that it is easily portable. The line array is flat on the bottom, so that it can be placed on the floor, or can be easily attached to a stabilizing stand (not shown). The line array is constructed and arranged for an operating range of about seven octaves, for example from about 120 Hz to 15 kHz.

The 2.5 inch diameter of each acoustical driver is equivalent to the wavelength of a sound wave having a frequency of about 5.4 kHz, which is approximately one octave below the highest frequency for which the loudspeaker system is designed. A line array loudspeaker using smaller diameter acoustical drivers maintains a smooth vertical dispersion to higher frequencies and a slow drop in sound energy intensity. An additional benefit of a line array loudspeaker according to the invention is the line array can transduce relatively large amounts of electrical energy. In one embodiment, a line array according to the invention can transduce seven watts of electrical power per square inch of radiating surface to sound waves.

Figure 2C:
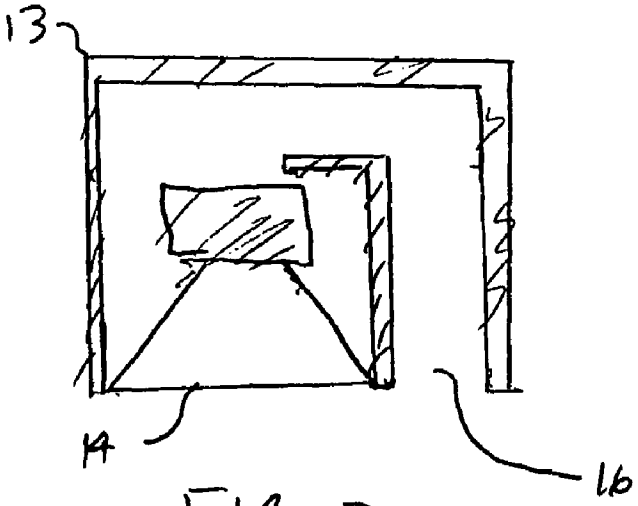
FIG. 2*c* is a cross-sectional view of the line array of FIGS. 2*b* or 2*c;*
Figure 2B:
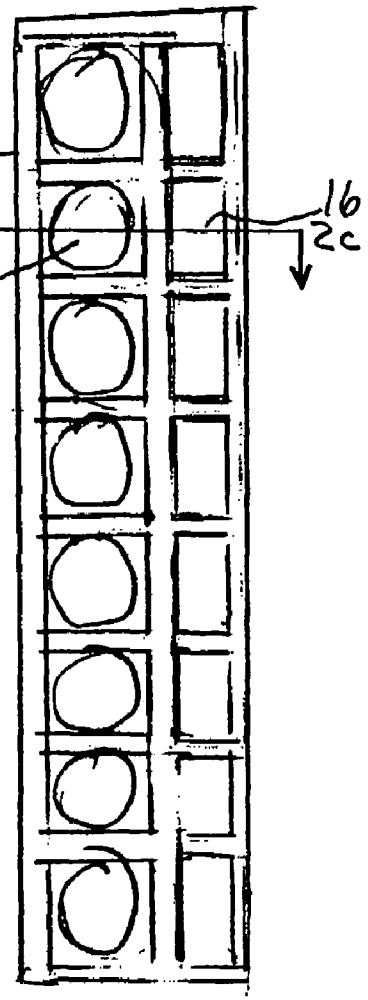
FIGS. 2*a* and 2*b* are front plan views of other line arrays according to the invention.
Figure 2A:
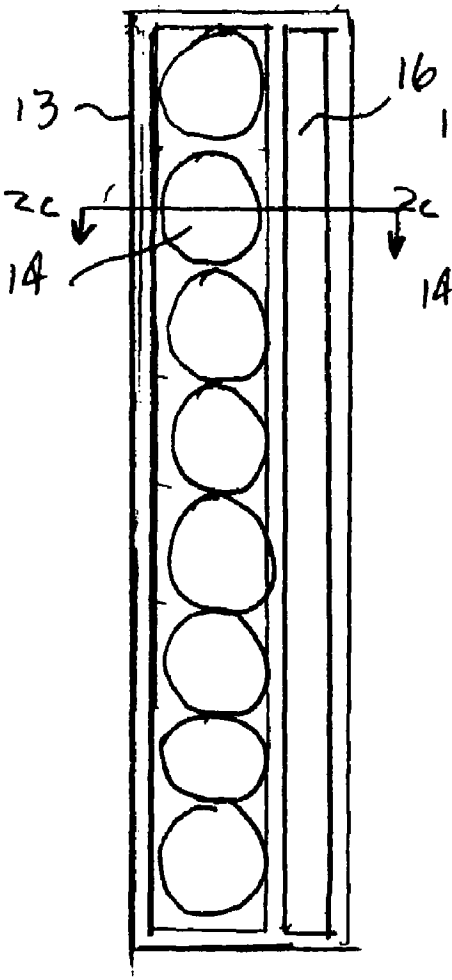

Referring now to FIGS. 2*a* -2*c*, there are shown other embodiments of the invention. In this embodiment enclosure 13 has a slot port 16 coupling the back (not shown) of the acoustical drivers 14 with the front of enclosure 13. In FIG. 2*b*, acoustical drivers 14 are individually enclosed, and the individually enclosed drivers each have a port 16. FIG. 2*c* shows a cross-sectional view taken along line 2*c*-2*c* of FIGS. 2*a* and 2*b*.

The sound energy intensity from a line array loudspeaker according to the invention drops off less rapidly than $$\frac{1}{r^2}.$$

Figure 3:
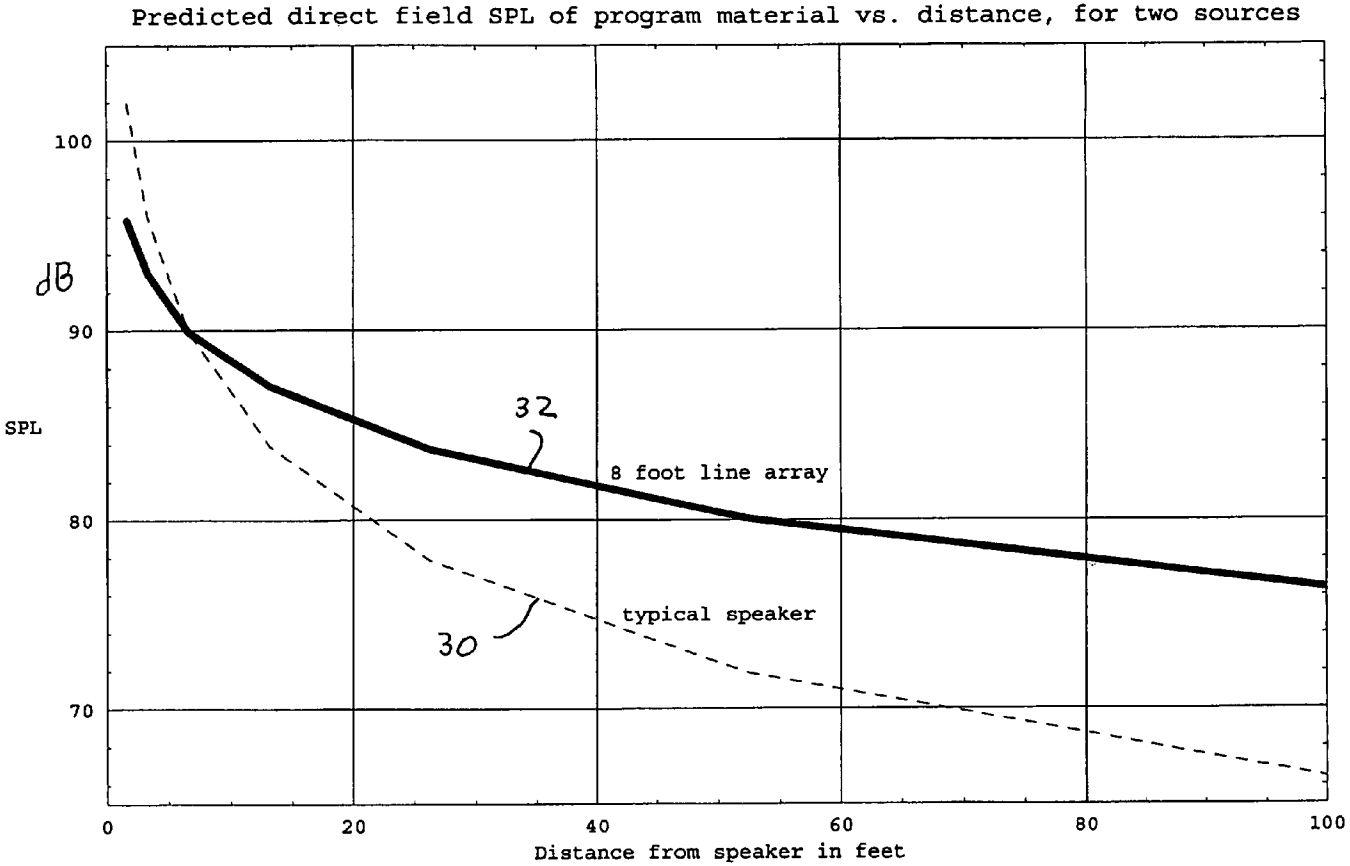
FIG. 3 is a calculated plot of sound pressure level (SPL) vs. distance for a conventional speaker and for a line array according to the invention.

Referring now to FIG. 3, there is shown a computed graph of sound pressure level (SPL) vs. distance from the speaker Curve 30 represents a typical compact loudspeaker, and curve 32 represents a line array loudspeaker according to the invention. The two speakers were equalized and adjusted to have the same frequency response and same SPL (90 dB) at 2 meters (6 feet 8 inches) from the speaker, and the SPL was calculated at floor height. The effect of floor reflection is included for both sources. It can be seen that at 60 feet from the speaker, the SPL of the line array loudspeaker according to the invention is only about 10 dB less than the SPL at 6 ft. 8 inches. At 60 feet from the speaker, the typical compact loud speaker is 18 dB less than at 6 ft. 8 in. The closely spaced small drivers provides for a greater portion of the line array loudspeaker to be radiating sound waves, even at high frequencies, so that a line array loudspeaker according to the invention continues to act as a line array loudspeaker (as opposed to a group of point sources) even at high frequencies. Since the individual drivers are small, a line array loudspeaker according to the invention has a wider horizontal dispersion, especially at higher frequencies, than conventional line array loudspeakers. It can also be seen from FIG. 3 that there is an adequate sound pressure level (about 76 dB) at 100 feet, while there is an unobjectable sound pressure level (about 90dB) where the performer is standing. Additionally, it can be seen from FIG. 3 that even if the performer is very close to the speaker, the sound pressure level is about 96 dB, while with a conventional compact speaker, the sound pressure level may be over 100 dB, which could be uncomfortable or even harmful to the performer. Six feet 8 inches may be a typical distance for rl, the distance from the line array loudspeaker system to the performer, while 60 to 100 feet may be typical distances for $r^2$, the distance from the speaker to the farthest point of the audience.

Referring to FIGS. 4*a*-4*d*, there are shown configurations of loudspeaker systems for a live source of sound, such as musical performers. Line array loudspeaker system 10 may be positioned behind performer 22, facing the audience in the listening area 11. Line source arrays tend to have minimal vertical dispersion, so that the sound energy intensity above the top of the speaker is significantly less than the sound energy intensity below the top of the speaker. To ensure that all portions of the audience get adequate sound, the height h of the line array loudspeaker system 10 may be variable, so that the top of a portable line array loudspeaker according to the invention can be made approximately as high as the head of the performer or the heads of the audience 24, whichever is higher. For convenience, the range of heights including the head of the performer and the heads of the audience will be referred to as the "intended listening height range."

Figure 4A:
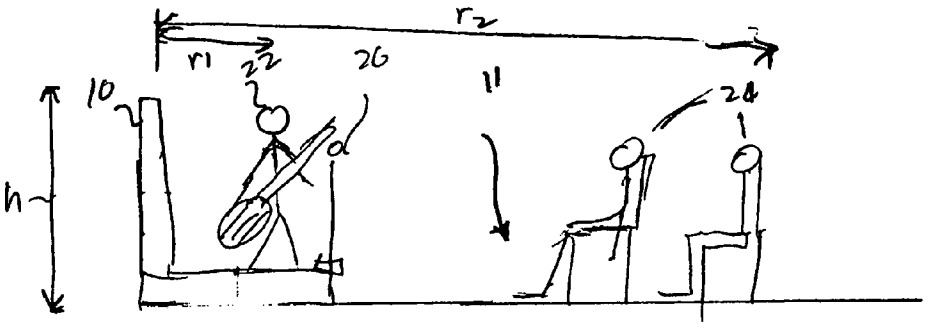
FIGS. 4*a*-4*d* are diagrammatic views illustrating features of the invention.
Figure 4B:
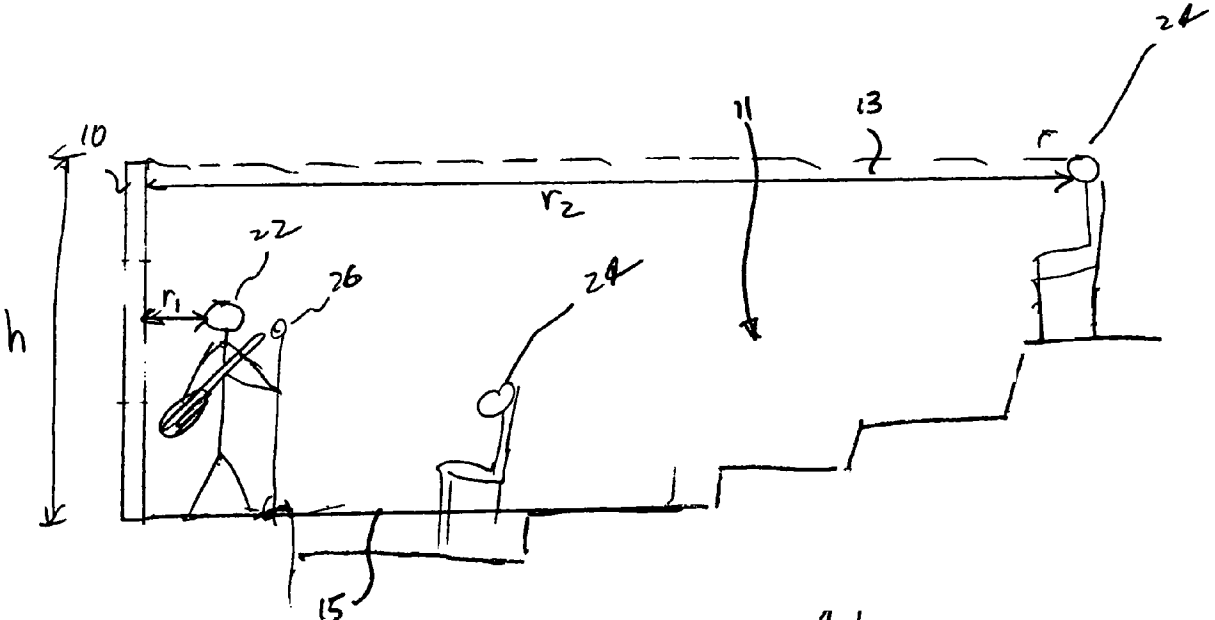

FIG. 4*b* illustrates a situation in which the floor is "raked," that is the floor is not a single horizontal plane but is rather an inclined plane or a series of multiple horizontal stepped planes or tiers. In FIG. 4*b*, the height h is dimensioned such that the intended listening height range lies between a two planes perpendicular to the line array loudspeaker, one of which (encompassing through line 13 and perpendicular to the plane of the drawing) is defined by the top of the line array loudspeaker and the second of which (encompassing line 15 and perpendicular to the plane of the drawing) is defined by the bottom of the line array loudspeaker.

Figure 4C:
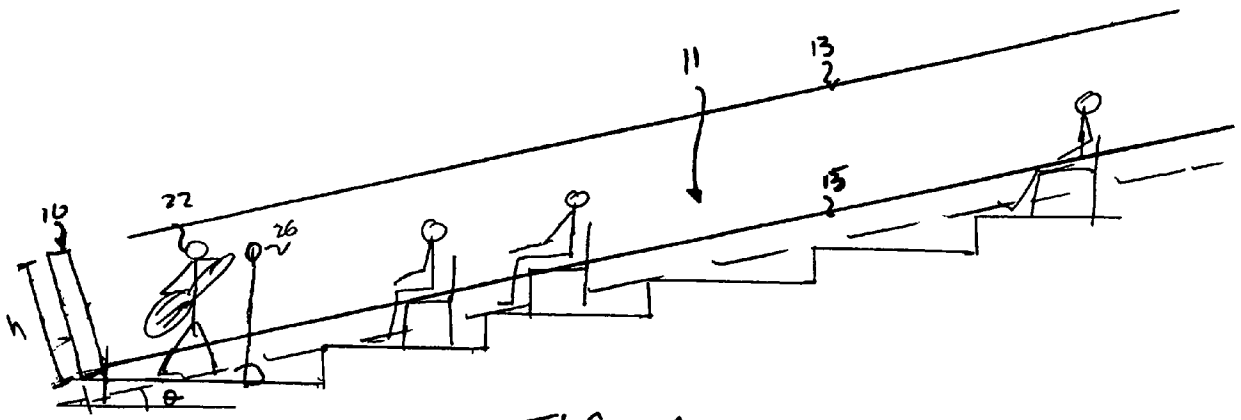
Figure 4D:
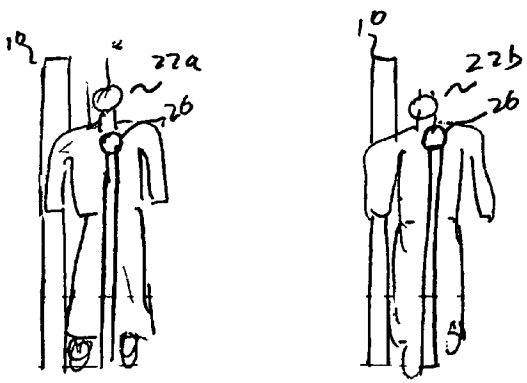

FIG. 4*c* illustrates another configuration with a raked floor, in which the floor is slanted at a raking angle θ (if the floor is planar, the raking angle is the angle of the floor relative to horizontal; if the floor is a series of multiple horizontal planes or tiers, the raking angle is the angle relative to horizontal of a line connecting common points, such of the front edge of the tiers). In FIG. 4*c*, the line source is slanted such that the major axis of the line source is perpendicular to the raking angle θ so that the two planes are inclined relative to horizontal. In the configuration of FIG. 4*c*, the line array should be dimensioned such that the height h of the line array is somewhat longer than the intended listening height range. If the line connecting common points is not straight, the angle at which the line array is tilted and the height of the line array are set such that the intended listening range lies between two planes perpendicular to the line array loudspeaker, one of which (encompassing line 13 and perpendicular to the plane of the drawing) is defined by the top of the line array loudspeaker and the second of which (encompassing line 15 and perpendicular to the plane of the drawing) is defined by the bottom of the line array loudspeaker. In the configuration of FIG. 4*c*, the height h of the line array does not need to be as long as in the configuration of FIG. 4*b*. FIG. 4*d*, illustrates another configuration in which a performing group has two performers 22*a* and 22*b*, and in which each performer has a line array 10*a* and 10*b*, respectively, placed nearby (in this case behind).

The configurations of FIGS. 4*a*-4*d* are especially advantageous. In a sound system according to the invention, the performer hears substantially the same sound that the audience hears. Additionally, since the line array loudspeaker can be placed behind the performer, it does not block the audience's view of the performer, an advantage that is accentuated by the fact that a line array loudspeaker is very narrow, and has a large height to width aspect ratio, which means that it is less noticeable to the audience. Since the sound field is substantially uniform, there is also little likelihood of feedback through microphone 26.

The small size, portability, modularity (described below), resistance to feedback through microphones, and low cost due to the simple electronics (described below) make line arrays according to the invention particularly attractive for performing groups. Each member of the group can have a line array in his or her near vicinity (typically to the side or behind the performer). This arrangement eliminates the need for expensive mixing circuitry, and for the need for a person to adjust the mixing circuitry, and for the need for so-called "back line" loudspeakers. Additionally, this arrangement provides a more pleasing and realistic psycho-acoustic effect for the audience, because the sound from each performer appears to come from the vicinity of the performer, not from a common loudspeaker system that may be in a location remote from one of the performers.

The small size, portability, modularity, resistance to feedback, and low cost also make line arrays according to the invention particularly attractive for use as portable sound systems for use in public places, for example as a public address system with an attached microphone for an orator, or with a source of audio signals to play pre-recorded messages and music.

A line array according to the invention can also be used in auditoria, meeting rooms, houses of worship, performance venues, and similar spaces in built-in, permanently attached configurations. A line array according to the invention can be placed with the line oriented vertically, and of appropriate length and placement such that the heads of the audience and performers are between horizontal planes defined by the top and bottom of the line array. Such a line array is advantageous because a line array according to the invention can be more easily integrated into the architecture, relatively easily installed, accessed for maintenance, while being unobtrusive. The relative distance between the line array and the performer and the line array and the audience is very flexible because of the gradual sound energy intensity drop off and the low likelihood of feedback through microphones.

Figure 5:
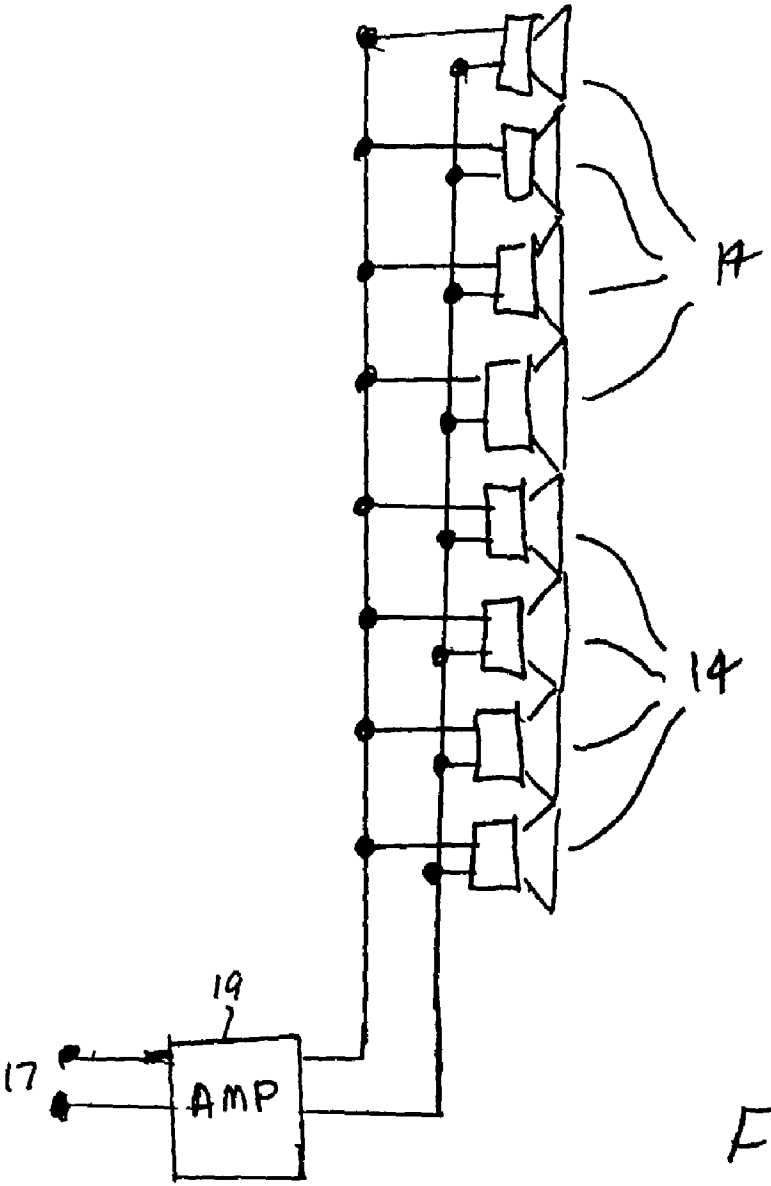
FIG. 5 is a circuit diagram illustrating the audio signal connection of the invention.

Referring now to FIG. 5, there is shown the electrical circuit of the system elements. Signal input is coupled to acoustical drivers 14 by single amplifier 19. The acoustical drivers are connected to the amplifier 19 in parallel, and there is no filtering or shading circuitry, so that all the acoustical drivers receive essentially the same signal at all frequencies. There may be equalization circuitry, not shown in this view, but the equalization circuitry would equalize all acoustical drivers the same, so that the signals received by all the acoustical drivers will be the same at all frequencies. The circuitry of FIG. 4 is relatively inexpensive and free from complexity, and allows a system according to the invention to be implemented with relatively few amplifiers and other components. The invention facilitates lengthening the line array loudspeaker system 10 by providing line array loudspeaker modules that can be attached so as to create a longer line array loudspeaker as discussed in the discussion of FIGS. 4*a* and 4*b*. Additionally, since electroacoustical transduction is split among many acoustical drivers, greater total amounts of energy can be delivered to the module because the total amount of voice coil structure is divided among a number of acoustical drivers, and the heat producing components are dispersed.

Figure 6:
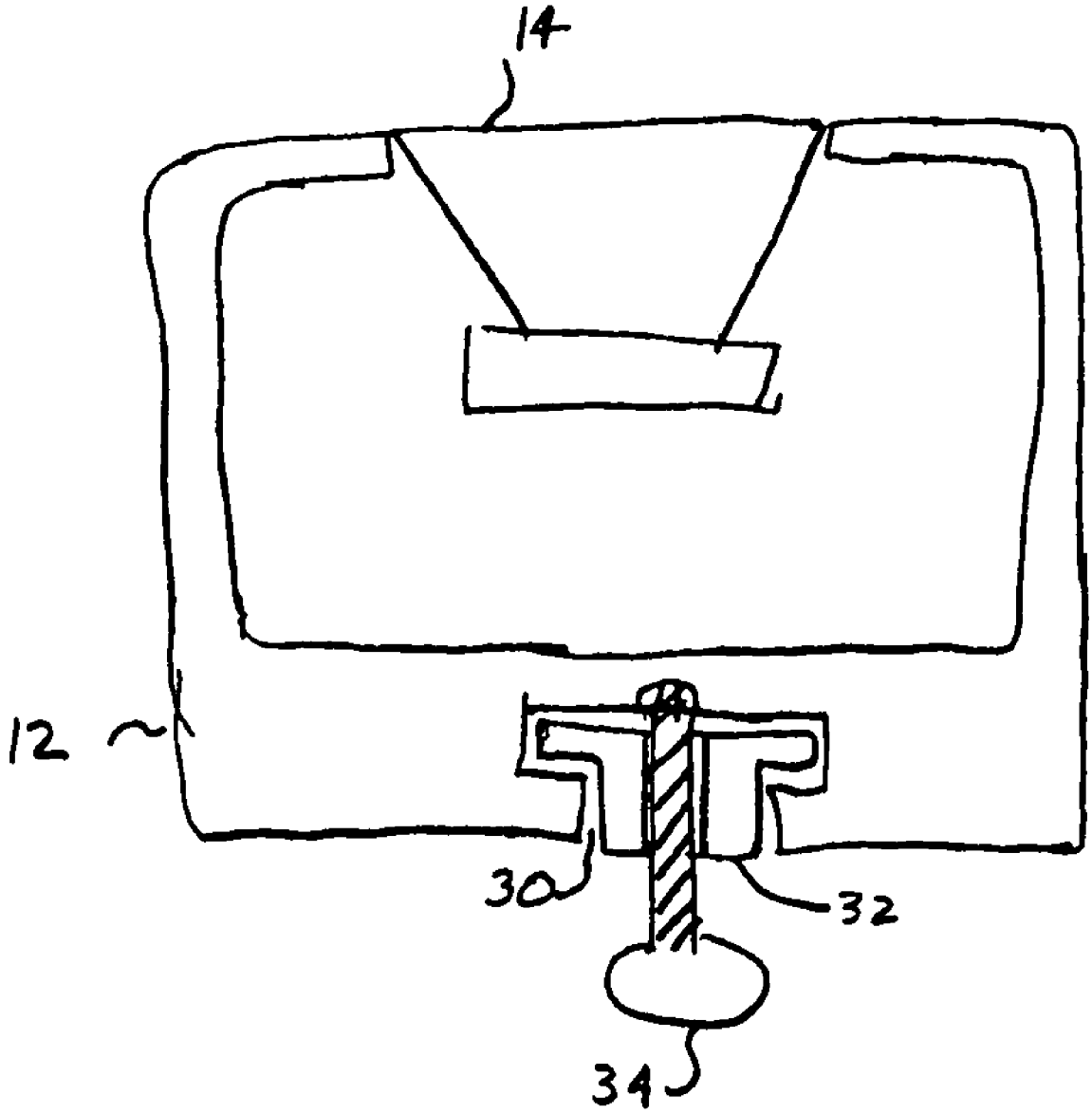
FIG. 6 is a cross-sectional view of the invention illustrating one of the features of the invention.

Referring to FIG. 6, there is shown a feature of the invention for lengthening the line array loudspeaker. Each of the enclosures 13 of the line array module loudspeakers 12 has in the back a T-shaped channel 30 into which flange 32 fits. Flange 32 is held in place by set screw 34 which may be a thumb screw. Channel 30 may have indentations, stops, or holes to accommodate set screw 14 to prevent slipping. Channel 30 may run the entire length of the enclosure 13, or may be only near the top and bottom of the enclosure 13. Flange 30 may then fit into the channel 30 of another enclosure of another line array module loudspeaker, and may be held in place by a second set screw 34, thereby securely attaching one line array module loudspeaker to another line array module line loudspeaker end to end to create a line array loudspeaker two modules in length. Additional line array module loudspeakers may be attached to the end in a similar way, to create a line array loudspeaker several modules in length. In addition to the relatively simple mechanical connection, the fact that each module has the simple electrical connections of FIG. 6, with no filtering or shading circuitry enables simple electrical connections between the signal source and the modules and between the modules. Modularization allows the individual modules to be easily portable, and assembleable in situ. This property makes a line array loudspeaker according to the invention particularly attractive for sound systems for musical performers.

If desired, in applications which require more bass sound energy, the line array loudspeaker may be accompanied by a separate bass unit, to augment the bass sound energy radiated by the line array loudspeaker. The separate bass unit may be placed remotely or nearby from the line array loudspeaker, and if placed nearby, may be attached to the base of the line array loudspeaker array to assist in stabilizing the line array loudspeaker.

It is evident that those skilled in the art may now make numerous modifications of and departures from the specific apparatus and techniques disclosed herein. Consequently, the invention is to be construed as embracing each and every novel feature and novel combination of features present in or possessed by the apparatus and techniques disclosed herein and limited only by the spirit and scope of the appended claims.

What is claimed is:

1. A loudspeaker system comprising, a first loudspeaker array, said first loudspeaker array comprising an enclosure having a width and a height and at least six acoustic drivers having radiating surfaces, each of said acoustic drivers having a diameter less than three inches, wherein said at least six drivers are positioned in said enclosure in a first substantially straight line, substantially regularly spaced so that the edges of said radiating surfaces are less than two inches apart, a second loudspeaker array comprising a second enclosure having said width and said height and at least six acoustic drivers having radiating surfaces, each of said second loudspeaker array acoustic drivers having a diameter of less than three inches, said second loudspeaker array acoustic drivers positioned in said second enclosure in a second substantially straight line regularly spaces so that the edges of said radiating surface are less than two inches apart, wherein said second loudspeaker array is constructed and arranged to be detachably secured to said first loudspeaker array in a manner that extends said first substantially straight line so that the height of said loudspeaker system is increased and so that the width of said loudspeaker system remains constant, the ratio of the height of said loudspeaker system to said width being at least twenty.

2. A loudspeaker system in accordance with claim 1, further comprising an attachment device for attaching said first loudspeaker array to said second loudspeaker array.

3. A loudspeaker system in accordance with claim 1, further comprising circuitry which provides essentially the same audio signal to all of said acoustical drivers in both of said loudspeaker arrays at all frequencies.

4. A loudspeaker system in accordance with claim 1, wherein said first loudspeaker array is portable.

5. A loudspeaker system in accordance with claim 1, wherein the first loudspeaker array and the second loudspeaker array have the same height.

6. A loudspeaker system in accordance with claim 1 wherein said loudspeaker system radiates sound energy and wherein said loudspeaker system is constructed and arranged to transduce to acoustical energy substantially at least seven watts of electrical energy per square inch of radiating surface.

7. A loudspeaker system in accordance with claim 1, wherein said first array is constructed and arranged to radiate sound in a predetermined frequency range.

8. A loudspeaker system in accordance with claim 7, wherein said second array is constructed and arranged to radiate sound in said predetermined frequency range.

* * * * *